US008937443B2

(12) United States Patent
Saccomanno

(10) Patent No.: US 8,937,443 B2
(45) Date of Patent: Jan. 20, 2015

(54) SYSTEMS AND METHODS FOR CONTROLLING LIGHT SOURCES

(71) Applicant: Honeywell International Inc., Morristown, NJ (US)

(72) Inventor: Robert J. Saccomanno, Montville, NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 14/248,239

(22) Filed: Apr. 8, 2014

(65) Prior Publication Data

US 2014/0203711 A1 Jul. 24, 2014

Related U.S. Application Data

(63) Continuation of application No. 11/350,953, filed on Feb. 10, 2006, now Pat. No. 8,791,645.

(51) Int. Cl.
*H05B 37/02* (2006.01)
*G09G 3/34* (2006.01)
(Continued)

(52) U.S. Cl.
CPC ..... *G09G 3/3406* (2013.01); *H05B 33/083* (2013.01); *H05B 33/0869* (2013.01); *G09G 3/006* (2013.01); *G09G 3/342* (2013.01); *G09G 2320/0233* (2013.01);
(Continued)

(58) Field of Classification Search
USPC ..... 315/185 R, 209 R, 210, 291, 307, 308, 315/312; 362/555, 222, 223, 249.02
See application file for complete search history.

(56) References Cited

U.S. PATENT DOCUMENTS 4,425,907 A 1/1984 Younghouse
4,617,057 A 10/1986 Plueddemann
(Continued)

FOREIGN PATENT DOCUMENTS

CN 202209652 U 5/2012
DE 10358447 B3 5/2005
(Continued)

OTHER PUBLICATIONS

Dzn, "Relationship between Critical Flicker-Frequency and a Set of Low-Frequency Characteristics of the Eye," J. of the Opt. Soc. of Am., vol. 44, No. 5, pp. 380-389, May 1954.
(Continued)

*Primary Examiner* — Jimmy Vu
(74) *Attorney, Agent, or Firm* — Ingrassia Fisher & Lorenz, P.C.

(57) ABSTRACT

A system for controlling a set of light sources may include a set of light sources, at least one optical conduit arranged relative to the set of light sources so as to collect excess light from the set of light sources, and at least one sensor coupled to the optical conduit and configured to sense light collected by the optical conduit. The system may also include a controller configured to control the emittance of the set of light sources based on the light sensed by the sensor. A method for controlling a set of light sources may comprise individually varying power supplied to at least some of the light sources in an imperceptible manner, sensing light emitted by a light source for which the power has been varied, and controlling the emittance of the set of light sources based on the sensed light.

14 Claims, 5 Drawing Sheets

(51) Int. Cl.
*H05B 33/08* (2006.01)
*G09G 3/00* (2006.01)

(52) U.S. Cl.
CPC . *G09G 2320/0626* (2013.01); *G09G 2330/021* (2013.01); *G09G 2330/12* (2013.01); *G09G 2360/144* (2013.01); *G09G 2360/145* (2013.01)
USPC ..... 315/291; 315/308

(56) References Cited

U.S. PATENT DOCUMENTS

| | | | | |
|---|---|---|---|---|
| 4,650,992 | A | 3/1987 | Ruhrmann | |
| 4,799,748 | A | 1/1989 | Brown | |
| 4,827,120 | A | 5/1989 | Stauffer | |
| 5,153,496 | A | 10/1992 | LaForge | |
| 5,237,349 | A | 8/1993 | Bruckhardt | |
| 5,459,328 | A | 10/1995 | Kadota et al. | |
| 5,561,732 | A | 10/1996 | Gergely | |
| 5,748,169 | A | 5/1998 | Okumura et al. | |
| 5,751,263 | A | 5/1998 | Huang et al. | |
| 5,783,829 | A | 7/1998 | Sealock et al. | |
| 6,127,783 | A | 10/2000 | Pashley et al. | |
| 6,137,816 | A | 10/2000 | Kinbara | |
| 6,153,980 | A | 11/2000 | Marshall et al. | |
| 6,219,099 | B1 | 4/2001 | Johnson et al. | |
| 6,224,216 | B1 | 5/2001 | Parker et al. | |
| 6,239,716 | B1 | 5/2001 | Pross et al. | |
| 6,259,838 | B1 | 7/2001 | Singh et al. | |
| 6,285,191 | B1 | 9/2001 | Gollomp et al. | |
| 6,396,466 | B1 | 5/2002 | Pross et al. | |
| 6,439,731 | B1 | 8/2002 | Johnson et al. | |
| 6,441,558 | B1 | 8/2002 | Muthu et al. | |
| 6,445,139 | B1 * | 9/2002 | Marshall et al. | 315/291 |
| 6,498,440 | B2 | 12/2002 | Stam et al. | |
| 6,507,159 | B2 | 1/2003 | Muthu | |
| 6,571,027 | B2 | 5/2003 | Cooper et al. | |
| 6,596,977 | B2 | 7/2003 | Muthu et al. | |
| 6,598,998 | B2 | 7/2003 | West et al. | |
| 6,608,614 | B1 | 8/2003 | Johnson | |
| 6,630,801 | B2 | 10/2003 | Schuurmans | |
| 6,646,654 | B2 | 11/2003 | Takagi | |
| 6,666,567 | B1 | 12/2003 | Feldman et al. | |
| 6,753,661 | B2 | 6/2004 | Muthu et al. | |
| 6,759,814 | B2 | 7/2004 | Vogel et al. | |
| 6,825,559 | B2 | 11/2004 | Mishra et al. | |
| 6,876,008 | B2 | 4/2005 | Bhat et al. | |
| 6,965,205 | B2 | 11/2005 | Piepgras et al. | |
| 6,974,229 | B2 | 12/2005 | West et al. | |
| 7,317,403 | B2 | 1/2008 | Grootes et al. | |
| 7,370,979 | B2 | 5/2008 | Whitehead et al. | |
| 7,507,001 | B2 | 3/2009 | Kit | |
| 7,521,879 | B2 | 4/2009 | Hong et al. | |
| 7,560,677 | B2 | 7/2009 | Lyons et al. | |
| 7,564,666 | B2 | 7/2009 | Ball et al. | |
| 7,622,871 | B2 | 11/2009 | Awalt et al. | |
| 7,633,463 | B2 | 12/2009 | Negru | |
| 7,646,029 | B2 | 1/2010 | Mueller et al. | |
| 7,646,154 | B2 | 1/2010 | Kang et al. | |
| 7,710,050 | B2 | 5/2010 | Preston et al. | |
| 7,800,316 | B2 | 9/2010 | Haug | |
| 7,834,678 | B2 | 11/2010 | Niessen et al. | |
| 7,851,909 | B2 | 12/2010 | Mishra et al. | |
| 7,911,151 | B2 | 3/2011 | Xu | |
| 7,986,107 | B2 | 7/2011 | Weaver et al. | |
| 7,994,725 | B2 | 8/2011 | Bouchard | |
| 8,004,211 | B2 | 8/2011 | Van Erp | |
| 8,111,001 | B2 | 2/2012 | Underwood et al. | |
| 8,188,679 | B2 | 5/2012 | Hoogzaad | |
| 8,207,691 | B2 | 6/2012 | Slot et al. | |
| 8,232,739 | B2 | 7/2012 | Underwood et al. | |
| 8,354,799 | B2 | 1/2013 | Yang et al. | |
| 8,400,075 | B2 | 3/2013 | Guo et al. | |
| 8,410,705 | B2 | 4/2013 | Bollmann et al. | |
| 8,513,896 | B2 | 8/2013 | Grebner | |
| 8,531,115 | B2 | 9/2013 | Blanchard et al. | |
| 8,531,128 | B2 | 9/2013 | Weaver et al. | |
| 8,569,970 | B2 | 10/2013 | Underwood et al. | |
| 2002/0159002 | A1 | 10/2002 | Chang | |
| 2003/0043107 | A1 | 3/2003 | Ruby et al. | |
| 2003/0216151 | A1 | 11/2003 | Kitano et al. | |
| 2003/0230991 | A1 | 12/2003 | Muthu et al. | |
| 2005/0012457 | A1 | 1/2005 | Wu | |
| 2005/0116921 | A1 | 6/2005 | Kim | |
| 2005/0148364 | A1 | 7/2005 | Yamashita | |
| 2005/0162737 | A1 | 7/2005 | Whitehead et al. | |
| 2005/0243022 | A1 | 11/2005 | Negru | |
| 2005/0248553 | A1 | 11/2005 | Feng et al. | |
| 2006/0038803 | A1 | 2/2006 | Miller et al. | |
| 2006/0192728 | A1 | 8/2006 | Kim | |
| 2006/0214177 | A1 | 9/2006 | Jones | |
| 2007/0103905 | A1 | 5/2007 | Kang et al. | |
| 2007/0108843 | A1 | 5/2007 | Preston et al. | |
| 2010/0194274 | A1 | 8/2010 | Hoogzaad | |
| 2010/0315016 | A1 | 12/2010 | Hoogzaad | |
| 2011/0068702 | A1 | 3/2011 | van de Ven et al. | |
| 2011/0068713 | A1 | 3/2011 | Hoogzaad et al. | |
| 2011/0236034 | A1 | 9/2011 | Schenk et al. | |
| 2013/0069527 | A1 | 3/2013 | Underwood et al. | |

FOREIGN PATENT DOCUMENTS

| | | | |
|---|---|---|---|
| EP | 1545163 | A1 | 6/2005 |
| JP | S63111682 | A | 5/1988 |
| JP | S63239873 | A | 10/1988 |
| JP | H10303467 | A | 11/1998 |
| JP | 2005310997 | A | 11/2005 |
| JP | 2006019594 | A | 1/2006 |
| JP | 2006245336 | A | 9/2006 |
| WO | 02097324 | A1 | 12/2002 |
| WO | 2004008023 | A1 | 1/2004 |
| WO | 2004068909 | A1 | 8/2004 |
| WO | 2006107199 | A2 | 10/2006 |

OTHER PUBLICATIONS

Zuidema et al., "Detection of light and flicker at low luminance levels in the human peripheral visual system. II. A mechanistic model," J. Opt. Soc. Am. A, vol. 2, No. 3, pp. 408-415, Mar. 1985.
Diez et al., "Instrumentation and Methodology for Revision of European Flicker Threshold," pp. 1-4, undated.
Shady et al., "Adaptation from invisible flicker," PNAS, vol. 101, No. 14, pp. 5170-5173, Apr. 6, 2004.
Hiyama et al., "LN-3: Four Primary Color 15-in. XGA TFT-LCD with Wide Color Gamut," Eurodisplay 2002, pp. 827-830.
Narendran et al., "Characterizing LEDs For General Illumination Applications: Mixed-color and phosphor-based white sources," SPIE, vol. 4445, pp. 137-147,2001.
USPTO Office Action for U.S. Appl. No. 11/350,953 dated Mar. 20, 2009.
USPTO Office Action for U.S. Appl. No. 11/350,953 dated Aug. 19, 2009.
USPTO Office Action for U.S. Appl. No. 11/350,953 dated Feb. 22, 2010.
USPTO Office Action for U.S. Appl. No. 11/350,953 dated Jun. 24, 2010.
USPTO Office Action for U.S. Appl. No. 11/350,953 dated Sep. 30, 2010.
USPTO Office Action for U.S. Appl. No. 11/350,953 dated Jan. 6, 2011.
USPTO Notice of Allowance for U.S. Appl. No. 11/350,953 dated Mar. 20, 2014.

* cited by examiner

SYSTEMS AND METHODS FOR CONTROLLING LIGHT SOURCES

This application is a continuation of and claims priority to co-owned, co-pending U.S. patent application Ser. No. 11/350,953 filed on Feb. 10, 2006, which is incorporated by reference in entirety.

TECHNICAL FIELD

This invention relates to systems and related methods for detecting light characteristics of light sources within a luminaire and controlling the light sources based on the same. In particular, the invention relates to control systems and related methods for detecting and controlling light characteristics of light emitting diodes used in backlighting systems for liquid crystal display panels.

BACKGROUND

Liquid crystal display (LCD) panels are typically illuminated via backlighting systems. In some conventional backlighting systems, an array of light emitting diodes (LEDs) is used to illuminate the LCD panel. The LEDs may be provided in various forms, including, for example, white LEDs comprising a blue emitting die and a phosphor to add green and red colors; white LEDs complemented by some red LEDs to achieve a warmer white hue; and red, green, and blue LEDs in defined ratios to achieve a desired white balance. An example of the foregoing can be seen in U.S. Pat. No. 6,666,567, hereby incorporated by reference herein and sharing a common assignee with the instant invention.

Arrays of LEDs may be used in sidelight arrangements, direct backlight arrangements, and hybrid sidelight/backlight arrangements. The term backlight is used herein to refer generally to any of these LED arrangements used to illuminate a LCD display panel.

A variety of factors may influence the performance (e.g., emittance) of an LED. For example, LED performance may vary due to, among other things, natural variations in the manufacturing process of LEDs, temperature, age, current, and/or solarization, for example. It is desirable to control such variations in order to provide a more uniform illumination of the LCD panel, and thus a better image quality.

Various techniques have been employed to monitor and control the variations of LEDs. For example, in cases where a mixture of differing color-emitting LEDs (e.g., red, green, and blue LED arrays) are employed, the desired white balance and overall luminance may be controlled by using a temperature feedback sensor to sense the junction temperature of the LEDs and an optical feedback sensor to sense the lumen output of each of the three LED arrays. Other conventional feedback systems comprise one or more temperature and light sensors positioned in predetermined locations. In one arrangement, light sensors are placed at an edge of a light guide and substantially centered between the light sources generating light entering the light guide. In another arrangement, the light sensors are placed adjacent to sampling LEDs inserted in each of a series of LEDs making up an array of LEDs. Examples of various LED control systems are disclosed in U.S. Pat. Nos. 6,441,558; 6,507,159; 6,596,977; and 6,753,661.

As the number of LEDs increases, the possible variation in performance also increases. For example, as the size of LCD panels increases, the number of LEDs required to illuminate the LCD panel also increases and so does the potential for variation in LED performance. Existing feedback and control systems become relatively complex when used in conjunction with large numbers of LEDs.

It may be desirable, therefore, to provide a control system for an LED array that is more comprehensive than conventional systems and is capable of monitoring and controlling a large number of LEDs.

Moreover, it may be desirable to provide a control system that is capable of use in conjunction with diffusely illuminated LCD panels and with a collimated backlight comprising a plurality of LEDs.

Such control systems are of benefit in applications other than backlighting for LCD panels used, for example, in conjunction with computer and/or television monitors. For example, such control systems may be used for applications, including, but not limited to, luminaires for general lighting (e.g. museums, supermarkets, etc.), medical applications (e.g. instrumentation, light therapy, endoscopy, surgical lighting, etc.) communications (fiber optics and free-space), signage (roadways, stadiums, indoor & outdoor advertising), and information displays (e.g. OLEDs). Other exemplary applications can also be found in U.S. Pat. No. 6,965,205. It should be appreciated that aside from LEDs, the techniques disclosed herein may apply to control over other types of light sources, including, for example, sources in the visible spectrum, UV, near infrared, infrared, and/or any combination thereof. Other suitable light sources which may be controlled and sensed according to the teachings herein include, for example, OLEDs, fluorescent lights, incandescent lights, and other light sources used for illumination applications.

SUMMARY

The present invention may satisfy one or more of the above-mentioned desirable features set forth above. Other features and advantages will become apparent from the detailed description which follows.

According to an exemplary aspect, as embodied and broadly described herein, a system for controlling a set of light sources may comprise a set of light sources and at least one optical conduit arranged relative to the set of light sources so as to collect excess light from the set of light sources. The system may further comprise at least one sensor coupled to the optical conduit and configured to sense light collected by the optical conduit and a controller configured to control the emittance of the set of light sources based on the light sensed by the sensor.

Yet another exemplary aspect may include a control system for controlling a set of light sources. The system may comprise a controller configured to vary the power to at least some of the light sources individually and in an imperceptible manner and at least one sensor configured to sense light emitted from a light source for which the power has been varied. The controller may further be configured to control the emittance of the set of light sources based on the sensed light.

According to yet a further exemplary aspect, a method for controlling a set of light sources may comprise varying power supplied to at least some of the light sources individually in an imperceptible manner, sensing light emitted by a light source for which the power has been varied, and controlling the emittance of the set of light sources based on the sensed light.

In the following description, certain aspects and embodiments will become evident. It should be understood that the invention, in its broadest sense, could be practiced without having one or more features of these aspects and embodiments. It should be understood that these aspects and embodiments are merely exemplary and explanatory and are not restrictive of the invention.

BRIEF DESCRIPTION OF THE DRAWINGS

The drawings of this application illustrate exemplary embodiments and together with the description, serve to explain certain principles. The teachings are not limited to the embodiments depicted in the drawings, but rather include equivalent structures and methods, as set forth in the following description and as would be known to those of ordinary skill in the art in view of the teachings herein. In the drawings.

DETAILED DESCRIPTION

According to various exemplary embodiments, a system for detecting light characteristics of a set (e.g., a plurality which may form an array) of light sources and controlling the light sources based on the detected light characteristics may comprise one or more optical couplers configured to receive light from the set of light sources, at least one sensor configured to sense a light characteristic of the received light, and a controller configured to control the light sources based on the sensed characteristics. By arranging one or more optical couplers, which may be in the form of optical conduits, so as to receive light produced by the light sources along a length (e.g., through a lateral surface and/or periphery) of the one or more conduits, a location of the light source emitting the light received by the conduit may be determined and control over the lights may be based on the sensed light, for example, based on variations detected from any of the light sources. Examples of light characteristics that may be sensed (individually or in combination) include wavelength, intensity, directionality, modulation, coherence, phase, and polarization.

Moreover, as will be explained, the one or more couplers may be positioned relative to the plurality of light sources such that the one or more couplers substantially receive a small portion of light (for example, excess light) emitted by the light sources. In other words, a substantial amount of the light received by the one or more optical couplers may be light from the light sources that would not otherwise be received by the element the light sources are illuminating, such as, for example, by a LCD panel. For example, such excess light may be light emitted from the light sources at angles that do not reach the element being illuminated and/or recycled light that is reflected and does not reach the element being illuminated.

Providing an optical coupler in optical communication with a photosensor and configured to receive light from a plurality of light sources according to various exemplary embodiments of the invention may permit a relatively robust feedback control system that is capable of being used in applications having large numbers of light sources (e.g., LEDs, OLEDs, incandescent lights, fluorescent lights, etc.) and capable of being relatively easily modified for various arrangements of those light sources. Moreover, a feedback system according to various exemplary embodiments may permit more precise control over the desired light emitted by the plurality of light sources by permitting light from each light source to be detected and any variations in each source to be determined. Based on such variations, the control system may alter a power to at least some of the light sources so as to produce a desired emittance from the set of light sources.

Figure 1:
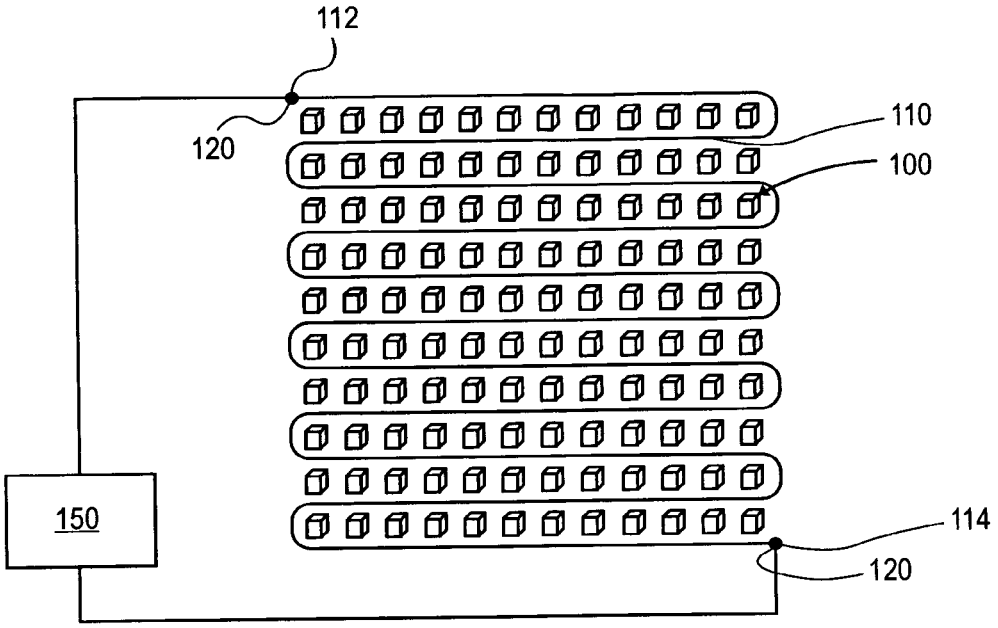
FIG. 1 is a schematic view of an array of light sources with a feedback control system according to an exemplary embodiment.

FIG. 1 illustrates an exemplary embodiment of a set (e.g., an array) of light sources 100, which may comprise, for example, LEDs, OLEDs, etc. in a backlighting arrangement for supplying light to a LCD panel. An optical coupler in the form of an optical conduit 110 may routed among the array of light sources 100, as shown. The optical conduit 110 may be configured so as to receive light from the light sources 100. For example, the optical conduit 110 may receive light along its length (e.g., through a lateral surface and/or periphery of the optical conduit 110). An interior of the optical conduit 110 may be configured so as to scatter the received light and thereby transmit the light through the conduit 110 until it reaches one or both ends 112 and 114 of the conduit. One or more sensors 120, which may be, for example, photosensors, may be placed at one or both ends 112, 114 of the conduit 110. The one or more sensors 120 may be electrically coupled to a control system 150 configured to determine from which light source 100 the light sensed was emitted and/or other characteristics of the light and control the light sources 100 based on the sensed measurement, as will be described in more detail below.

Figure 2:
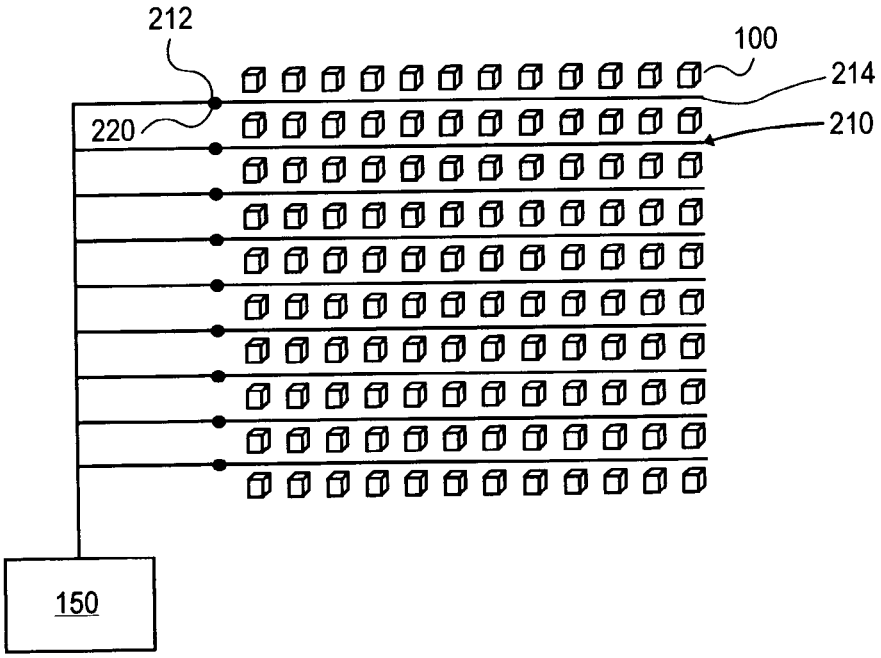
FIG. 2 is a schematic view of an array of light sources with a feedback control system according to another exemplary embodiment.

FIG. 2 illustrates another exemplary arrangement of an array of light sources 100, which may comprise, for example, LEDs, OLEDs, etc. in a backlighting arrangement for supplying light to a LCD panel. In the arrangement of FIG. 2, a plurality of optical conduits 210 are routed among the rows of light sources 100, rather than a single conduit 110 as shown in FIG. 1. Each optical conduit 210 is configured to receive light emitted by the LEDs along its length (e.g., through a lateral surface and/or periphery of the optical conduit 210). As with the optical conduit 110 of FIG. 1, each optical conduit 210 may have an interior configured so as to scatter the received light and thereby diffuse the light through the conduit 210 until it reaches one or both ends 212 and 214 of the conduit 210. One or more sensors 220, which may be, for example, photosensors, may be placed at one or both ends 212 and 214 of each conduit 210 and electrically coupled to a control system 150 configured to determine from which light source 100 the sensed light was emitted and/or other characteristics of the received light and control the light sources 100 based on the sensed measurements, as explained in more detail below. Although, FIG. 2 shows sensors 220 placed at an end 212 of each conduit 210, sensors 220 may alternatively or additionally be placed at end 214, and mirrors may be placed at ends that do not have an adjacent photosensor.

Exemplary photosensors that may be used for sensors 220 include, for example, fast-response time photodiodes responsive to visible light, such as those commercially available from Advanced Photonix (Camarillo, Calif.), Hamamatsu Photonics (Hamamatsu City, Japan), PerkinElmer Optoelectronics (Fremont, Calif.), and UDT Sensors (Hawthorne, Calif.). Those photodiodes are conditioned by one or more amplifiers to achieve a desired characteristic as required by the LED control algorithm. Moreover, the amplifier design should consider bandwidth, stability, offset, and gain, while minimizing noise. Such amplifiers which may be suitable for use with embodiment disclosed herein are taught, for example, in Photodiode Amplifiers, J. Graeme, ISBN 0-07-024247-X.

Those having skill in the art will recognize that the arrangements of the light sources 100 and optical conduits 110 and 210 shown in FIGS. 1 and 2 are exemplary only. Various other arrangements of the light sources 100 and the optical conduits 110 and 210 are contemplated as being within the scope of the invention. By way of example only, the conduits 110 and 210 may be arranged so as to be routed substantially vertically among the columns formed by the array of light sources 100. In an alternative, one or more conduits and sensors may be arranged so as to correspond to one or more subsets of light sources 100 in the array. Other arrangements may also be used and those having skill in the art would understand how to select such arrangements depending on, among other things, the desired control over the light sources 100 and application for which the sensing and control system are being used.

Figure 3:
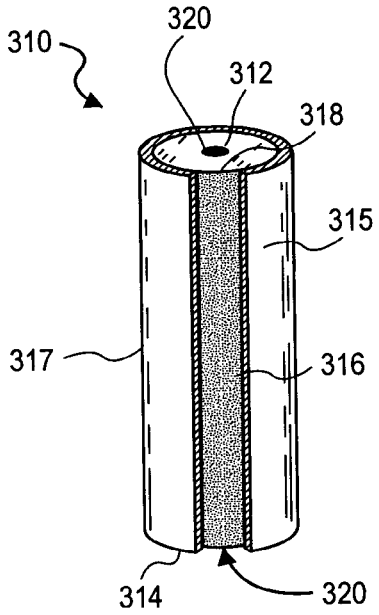
FIG. 3 is a perspective view of an optical conduit according to an exemplary embodiment.

An exemplary embodiment of an optical conduit that may be used in conjunction with the systems of FIGS. 1 and 2 is described in U.S. Pat. No. 4,827,120, the entire contents of which are incorporated herein by reference and is illustrated in FIG. 3. Referring to FIG. 3, an optical conduit 310, which may be in the form of a tube or cylinder, for example, may comprise a diffusing material and have substantially clear ends 312 and 314. For example, ends 312 and 314 may be open and/or comprise a transparent material, such as, for example, acrylic or silicone. In various exemplary embodiments, the optical conduit may be manufactured in a manner similar to an optical fiber. Alternatively, the silicone and photopolymer material(s) may be dispensed on the LED substrate. Such dispensing equipment can be obtained from EFD (East Providence, R.I.) or Asymtek (Carlsbad, Calif.). The surface upon which they are dispensed can be preconditioned for maximum reflection, such as a low index coating (e.g. teflon-based, to promote total internal reflection), a specular reflector such as aluminum or silver, or a diffuse reflector such as expanded PTFE. Alternatively, the surface can be hydrophobic as taught in U.S. Pat. No. 4,617,057, thereby controlling the cross-sectional section of the dispensed material to approximate a circular fiber or some other desired shape. The dispensed material can terminate, for example, at the optical window of a surface-mounted photosensor. A coating of material 315 which is reflective at least on an inner surface thereof may surround the conduit 310 in such a way so as to leave a window 316 which runs substantially along the length of the conduit 310. Light may enter the conduit 310 through the window 316 and appear essentially as a spot. The window 316 may be coated, for example, on an interior thereof, with a highly diffusing coating 318 which serves to scatter the light into the interior of the conduit 310 so as to make operation insensitive to the direction of the incident radiation beam to the conduit 310. Light entering the conduit 310 is diffused toward the ends 312 and 314 thereof. Due to the reflective nature of layer 315, light entering the conduit 310 via the window 316 is substantially prevented from escaping the conduit 310 throughout the major portion of its lateral surface 317. It is, of course, important that the light-loss mechanisms (e.g., bulk absorption, surface absorption, and scatter losses) be accounted for in order to maximize the discrimination of pulses by the respective photosensors, and therefore an adequate signal-to-noise (S/N) ratio must be maintained throughout the optical path. The optical power available to each photosensor can be modeled by any suitable ray-trace software such as ASAP from Breault Research Organization (Tucson, Ariz.).

Photosensors 320 (e.g., photodiodes) may be mounted on the ends 312, 314 of the conduit 310 so as to receive the light that is diffused by the conduit 310 and produce electrical output signals in accordance with the light received. The photosensors 320 may be electrically coupled to a control system and/or processor (not shown). If the light received by the conduit 310 is located at a position substantially in the center of the conduit 310, then the amount of light reaching each photosensor 320 will be substantially the same and the output signals from the photosensors 320 will be substantially equal. If the light enters the conduit 310 nearer to one end or the other, then the amount of light that reaches the nearer end will be greater than the amount of light reaching the other, farther end. Accordingly, the output of the corresponding photosensor 320 at that nearer end will be greater than the output of the photosensor 320 at the other, farther end. By comparing these signals, for example, taking the difference between the outputs of the photosensors and dividing by the sum of the outputs of the photosensors, an indication of the position of where the light enters the conduit 310 may be obtained for whatever measurement or control purposes may be desired. As will be explained in more detail below, when used to sense light emitted from an array of light sources 100, as shown in FIGS. 1 and 2, for example, the emittance of a particular light source 100 may be determined from among the array of light sources 100 so as to control the overall emittance of the array.

For further details regarding suitable structures, materials, and operation of the optical conduit 310, photosensors 320, and processor/control system coupled to the photosensors 320 for detecting a position of light entering the conduit 310, reference is made to U.S. Pat. No. 4,827,120, incorporated by reference herein.

In addition to the exemplary embodiment of FIG. 3, a variety of other structures may be suitable for the optical conduits described herein. For example, numerous optical fibers comprising scattering cores may be used, including, but not limited to, optical fibers disclosed in U.S. Pat. Nos. 4,425,907; 4,650,992; 4,799,748; 4,827,120; 5,561,732; and 5,783,829, the entire disclosures of which are incorporated herein. Moreover, optical conduits comprising scintillating and/or fluorescent fiber optics structures, such as, for example, those available from Industrial Fiber Optics, Inc. of Tempe, Ariz., or comprising side-emitting fiber optics, such as, for example, those available from Lumenyte of Foothill Ranch, Calif., or Fiberstars of Fremont, Calif., also may be used. As used herein, optical conduits may refer to any suitable refractive or reflective optical conductor of any shape, including, but not limited to, circular optical fibers that conduct via total internal reflection.

According to various exemplary embodiments, control system 150 may be architecturally structured similar to existing LED control systems, for example, the Color Management System Feedback Controller, P/N HDJD-J822, from Avago Technologies (San Jose, Calif., formerly Agilent Technologies). In particular, control system 150 may be implemented as an integrated circuit that receives feedback from photosensors (such as sensors 120, 220, 320) to adjust the pulse width modulated drivers for banks of red, green, and blue LEDs in order to maintain color and brightness settings over time-and-temperature. In an exemplary embodiment, a device like the HDJD-J822 may be used in control system 150 as an outer-loop controller to maintain color and overall brightness.

Figure 6:
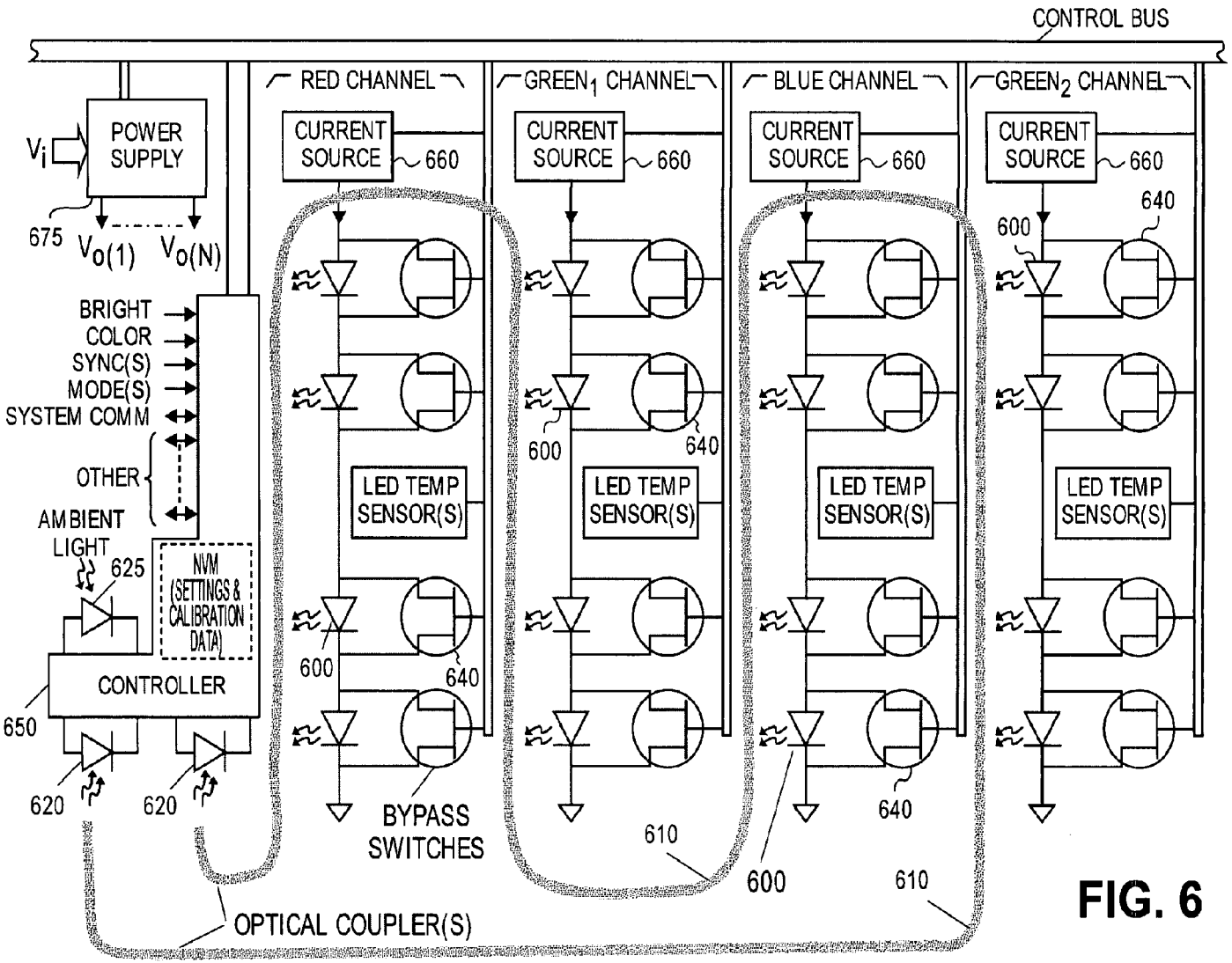
FIG. 6 is a schematic block circuit diagram of a feedback control system according to an exemplary embodiment.

Control system 150 may then be augmented with an inner-loop conduit to adjust each individual LED to compensate for any small-area and/or large-area non-uniformities. An example of control system 150 using an inner-loop conduit is shown in FIG. 6, which is described in more detail below. One skilled in the art will also recognize that control system 150 may be configured without the need for a device like the HDJD-822.

According to various exemplary embodiments, it should be understood that the optical conduit may be routed among the light sources, such as light sources 100 and 210, so as to receive light from a respective row of light sources emitted in a direction facing substantially above each respective row or below each respective row as shown in FIG. 1. An example of such a conduit is shown in FIG. 3. In FIG. 3, the optical conduit 310 may be routed such that the window 316 faces only one row of light sources when positioned between two rows. Similarly, according to various exemplary embodiments, when using the optical conduit 310 in conjunction with the arrangement of FIG. 2, the window 316 of each conduit 210 may face either downward or upward toward a respective row of LEDs or may otherwise be configured so as to receive light facing in a direction either above each respective row or below each respective row of light sources 100 in FIG. 2. In arrangements where one or more optical conduits are routed along columns of light sources, the window 316 may face either toward a right side or a left side of the conduit so as to receive light from a column of lights positioned on that side of the conduit.

Those having ordinary skill in the art would understand how to arrange the optical conduits relative to the light sources such that the conduits receive light from the light sources in a manner that permits a determination of which light source, relative to a position along the length of the conduit, emitted the light sensed by a photosensor. For example, as is known in the art, electronic signal-gating techniques can be employed, such as taught in U.S. Pat. No. 6,571,027 and the like. For example, as each LED is pulsed, a counter can be configured to trigger the sampling of the photosensor based on knowledge of the optical path length and its corresponding effect on the time delay to the photosensor. According to various exemplary embodiments, the optical conduit may be placed relative to the light sources such that the light received by the conduit is excess light emitted by the light sources, or, in other words, is light that is substantially unuseable. In general, light that is unuseable is light that is emitted beyond a predetermined angle that will not reach the element that is being illuminated by the light sources. By way of example, in the case of light sources used in a LCD backlight system, the optical conduit may be arranged and configured so as to receive light from the light sources that is beyond a predetermined angle and would not otherwise reach the LCD panel. The predetermined angle beyond which light emitted by a light source is considered "excess" may differ depending on the application, such as, for example, what is being illuminated by the light sources. Furthermore, in some exemplary applications, the predetermined angle may vary for one or more light sources of a set of light sources. In the exemplary embodiments illustrated in FIGS. 1 and 2, light emitted in a direction facing substantially below and to the side of each light source 100, is received by the optical conduit since most, if not all, of the light emitted in those directions will not reach the LCD panel. Thus, this light is typically not used in illuminating the LCD panel and can be considered excess light. In the case of side-emitting LEDs (see, e.g. U.S. Pat. No. 6,974,229), the optical coupler can be positioned directly above each lamp to receive light leakage through the top of the side-emitting optic.

The light from the one or more conduits can be directly coupled into the entrance aperture of the photosensor, or may be "funneled in" as is known in the art of optical fibers by way of one or more imaging or non-imaging optical elements.

Figure 4:
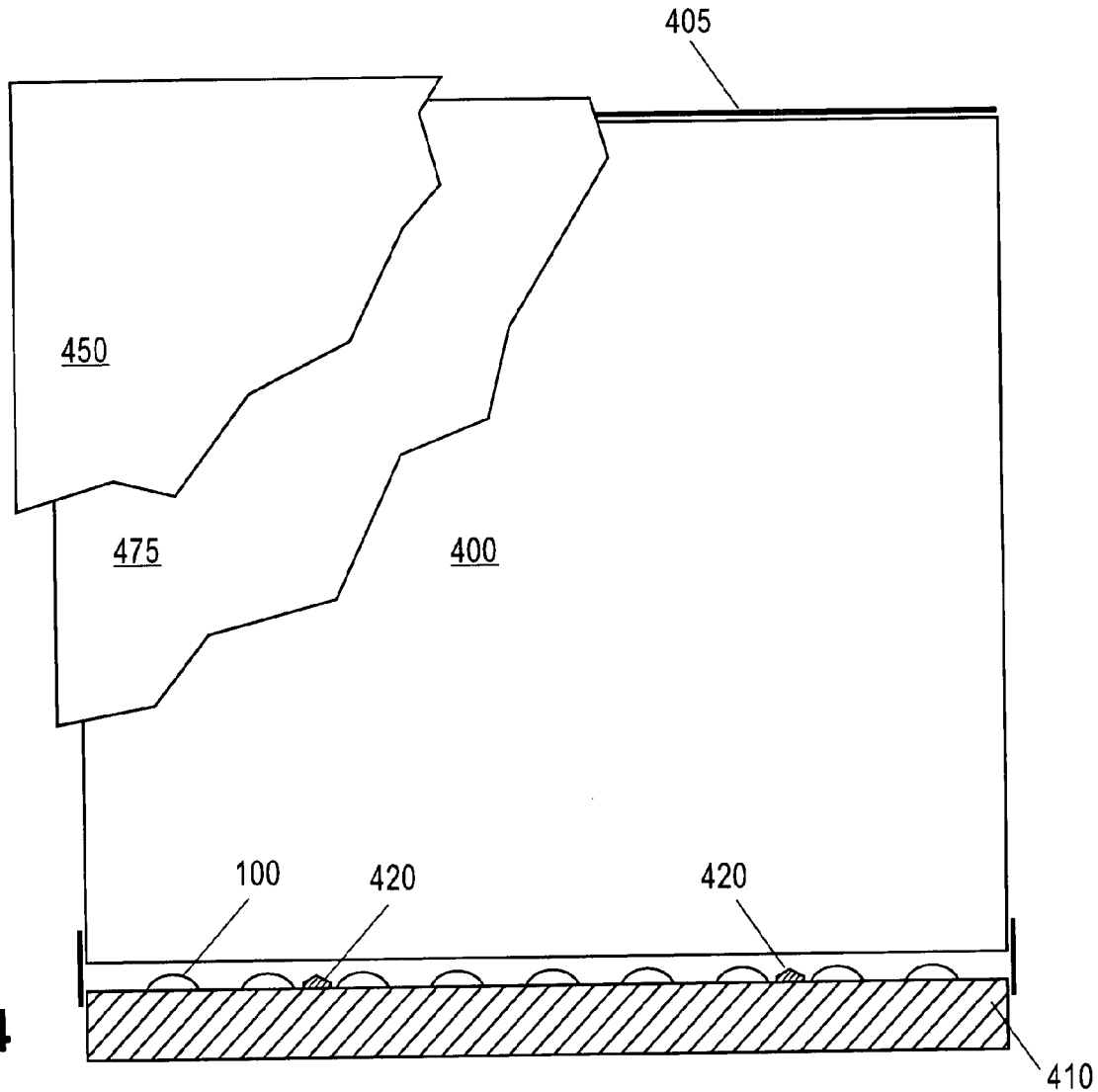
FIG. 4 is a partial plan view of an edge lighting arrangement according to an exemplary embodiment.
Figure 5:
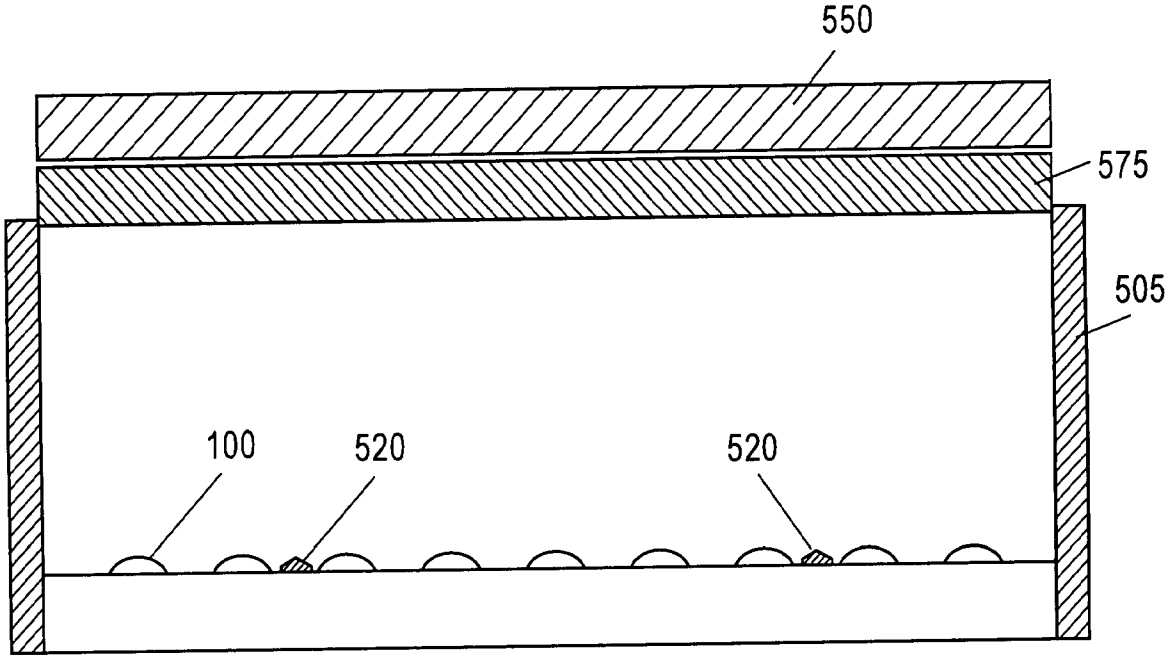
FIG. 5 is a side view of a direct lighting arrangement accordingly to an exemplary embodiment.

Alternate exemplary approaches to optical coupling between the LEDs and the photosensors are shown in FIGS. 4 and 5. In the exemplary embodiment of FIG. 4, light from the light sources 100 (e.g., LEDs) travels along a light guide 400. A portion of the light that is not extracted out of the light guide 400 and directed toward an LCD panel 450 (and optionally one or more light management films 475, such as BEF and/or DBEF films from 3M) is reflected back via a reflective surface 405 (e.g, reflective film) at an end of the light guide 400). The reflected light then reaches the substrate 410 (e.g., an electrical/thermal substrate) upon which the LEDs 100 are mounted. The substrate 410 also may be host to several photosensors 420 which are configured to sense the reflected light, and, along with a controller (not shown), may control the emittance of the set of light sources 100, as described herein.

In the exemplary embodiment of FIG. 5, the light from the LEDs 100 travels through air until striking light management films 575, such as BEF and/or DBEF films from 3M, and being passed to an LCD panel. As is known in the art, a portion of the light will be recycled back toward the LEDs 100 via reflection off films 575 (and reflective surface 505). The recycled light may be sensed by the photosensors 620 and the emittance of the set of light sources controlled by a controller (not shown), for example, as described herein.

Thus, the exemplary embodiments of FIGS. 4 and 5 utilize the light guide 400 and reflective surface 405 or the light management films 575 (and for some rays reflective surface 505) as the optical couplers to transmit light (e.g, excess light not otherwise being used to illuminate the LCD panel) from the LEDs to the photosensors 420 or 520 for control over the emittance of the LEDs.

Various methods may be used to sense the emittance from the light sources 100 and control the light sources 100, such as, for example, by varying the power individually to the light sources 100, based on such emittance. According to an exemplary embodiment, a sequential pulsing may be employed. For example, only one light source 100 at a time may be turned on within the set (e.g., array) of lights sources 100 and the emittance from that light source 100 measured by the photosensor. In another exemplary embodiment, all of the light sources 100 may be on and may be individually pulsed at a higher power than the current steady state power. The emitted light may be sensed both before and during the pulsing and a difference between the two measurements may be determined that is indicative of the pulsed light source's emittance.

According to various exemplary embodiments, the individual light sources 100 may be tested in an imperceptible manner to an observer. That is, the testing of the light sources for measurement and control of the emittance of the light sources may be done in such a way that is substantially imperceptible to an observer so as to permit undisturbed viewing, for example, of a LCD panel or other image display element illuminated by the light sources 100. In an exemplary approach, the light sources 100 may be pulsed above the critical flicker frequency, which is the frequency of an intermittent light source at which the flickering light ceases to be perceived and instead appears to an observer as a continuous light. There are a multitude of factors that determine the perception of flicker by an observer, including, among other things, the intensity and size of the test stimulus. Thus, the critical flicker frequency for the light sources 100 may be calculated and the pulsing of the light sources 100 may be controlled so as to be above the critical flicker frequency. For further information regarding critical flicker frequency, reference is made to H. De Lange Dzn, "Relationship between Critical Flicker-Frequency and a Set of Low-Frequency Characteristics of the Eye," *Journal of the Optical Soc. of Am.*, Vol. 44, No. 5, May, 1954, pp. 380-89, the entire contents of which are incorporated by reference herein.

In another exemplary approach, testing the light sources 100 in an imperceptible manner may include ramping up the power to a light source 100 to be tested. The power may be increased by a few percent at frequencies below about 0.5 Hz so as to increase the light source's emittance. Those having ordinary skill in the art would understand that numerous techniques for testing the light sources 100 in a manner that is imperceptible to an observer may be used, and use of the critical flicker frequency and ramping up of power are two nonlimiting examples of such techniques.

According to various exemplary embodiments, to individually test each light source 100, a driver capable of driving the light sources 100 individually may be utilized. One example of a suitable driver includes Texas Instruments (Dallas, Tex.) LED Driver IC (P/N TLC5940), which is capable of driving 16 LEDs individually and includes a built-in sequential-delay between each of the 16 ouptuts.

In various exemplary embodiments, after measuring the emittance of the light sources 100, the light sources may be controlled in a variety of ways. For example, the controller may alter the power supplied to one or more of the light sources 100 so as to increase and/or decrease the emittance of one or more light sources 100. In another exemplary embodiment, at least some of the light sources 100 in a set may emit light of a color that differs from a color of light emitted by other light sources in the set. For example, some of the light sources may emit a red light and other light sources may emit a green light. In addition to red and green, still others of the light sources may emit a blue light. Based on testing and sensing the emittance of the light sources 100, the control system may control the light sources so as to achieve a desirable color balance, for example, a desirable white balance, of the overall light emitted by the plurality of light sources 100. Those having ordinary skill in the art would understand a variety of techniques that may be used to control the light sources 100 based on the sensed emittance of those light sources 100 in order to provide a desirable illumination by the light sources 100.

In the case of information display illumination, for example, an array of multicolored LEDs can also be time-sequenced to achieve a variety of effects, such as field sequential color displays for direct-view (see U.S. Published Application No. 2005/0116921 A1) and projection systems (see U.S. Pat. No. 6,224,216), reduction of image blur (see U.S. Published Application No. 2005/0248553 A1), and other desired effects.

An exemplary block circuit diagram of an LED-based illumination system is shown in FIG. 6. In the exemplary embodiment of FIG. 6, four types of LEDs 600 are shown, each with a different dominant wavelength, as discussed, for example, in *Four-Primary Color* 15-*in. XGA TFT-LCD with Wide Color Gamut*, I. Hiyama, et al, Eurodisplay 2002, pgs 827-830, incorporated by reference herein. As shown in FIG. 6, a controller 650 controls the output of current sources 660 to coordinate the current sourced to LEDs 600. In addition, controller 650 may control the operation of a bypass switch 640, or electrically-controlled shunt, that is placed across each LED 600. Bypass switch 640 may be an electrically-controlled shunt or transistor that is used to individually extinguish each LED 600. Examples of such bypass switches may be found, for example, in U.S. Pat. Nos. 5,459,328 and 6,239,716. The controller 650 coordinates the current sources 660 and bypass switches 640 as a function of the LED temperatures, photosensors, and various external inputs.

For purposes of illustration, FIG. 6 depicts four current sources 660, one for each color channel (e.g., Red, $Green_1$, Blue, and $Green_2$), wherein the characteristics thereof can be altered by the controller 650. One such source is disclosed in U.S. Pat. No. 6,680,834, having a common assignee with the instant application and incorporated by reference herein. These current sources 660 can be turned off, for example, to accommodate field-sequential operation. The current sources 660 preferably have the appropriate capacity, response time, and stability to handle any combination of bypass switch engagements and disengagements of bypass switches 640. In one embodiment, controller 650 provides the LED current for LEDs 600.

The bypass switches 640 permit the controller 650 to selectively turn off (or on) individual LEDs 600 within a string. Such switches 640 are akin to the bypass switches used across individual battery cells within a string, such as those disclosed in U.S. Pat. No. 5,153,496, incorporated by reference herein.

In the exemplary embodiment of FIG. 6, an optical coupler is shown in the form of an optical conduit 610 similar to the optical conduit described with reference to FIGS. 1 and 3. However, it should be understood that the optical coupler may have a variety of forms and may functionally represent any optical feedback means, including for example those depicted in FIGS. 2, 4 and 5.

A power supply 675 receives power from a source, Vi, and provides one or more supply voltages, Vo(1)-Vo(n). The power supply 675 also may be configured, as shown, to have control signals that interface to one or more functional blocks, including, for example, the controller 650.

The exemplary embodiment of FIG. 6 also shows photosensors 620 and 625. Two photosensors 620 may be used for LED feedback, and another photosensor 625 may be used to sense ambient light for an optional autobrightness mode, whereby the controller 650 increases the LED power (in the case of a backlighted transmissive LCD) or decreases the LED power (in the case of a frontlighted reflective LCD) as a function of increasing ambient light in order to maintain an acceptable level of display contrast.

Controller 650 may further be configured to respond to various external signals for controlling the operation of a display. For example, controller 650 may be configured to respond with external signals for adjusting the brightness setting of a display; adjusting the desired white balance; aligning the LED refresh-rate with one or more video sources, or between multiple illumination sources to avoid beat frequencies; switching between various modes, such as switching between test, calibration, and operational modes; selecting between various operational modes, such as field-sequential and non-field-sequential operational modes; and controlling one or more communication links for test, calibration, and operational modes Those skilled in the art would understand that LEDs within an array can be driven singly (see, e.g., U.S. Pat. No. 6,646,654), in a row/column matrix (see, e.g., U.S. Pat. No. 5,751,263), in series/parallel combinations (see, e.g., U.S. Pat. No. 6,507,159), and various combinations thereof (e.g., a matrix with series-connected LEDs is disclosed in U.S. Application Publication No. 2002/0159002). Those of skill in the art also recognize that there may be variations from LED-to-LED, resulting from conditions in the manufacturing process, as well as effects due to temperature and solarization (see, e.g., U.S. Pat. No. 6,630,801 and *Characterizing LEDs For Gen-*

*eral Illumination Applications: Mixed-Color And Phosphor-Based White Sources*, N. Narenderan et al, Solid State Lighting and Displays, 2001, SPIE Vol. 4445).

Assuming that in manufacturing, the system shown in FIG. 6 is connected to a test fixture, and after initial power-up, all LEDs are illuminated at 50% power, with no feedback compensation employed at this point, after thermal stabilization, controller 650 may measure and record the LED temperatures (individually, or estimated by their proximity to the distribution of temperature sensors as shown in FIG. 6). At this point, the temperature, and current within each LED is known by controller 650.

Each LED 600, in sequence, may then be pulsed off by controller 650 by activation of its respective bypass switch (note that the current remains fixed for the remaining activated LEDs). This results in a difference in light sensed by conduit 610 and photosensors. The difference is indicative of the contribution from the particular LED that was switched off. Alternatively, using another driver approach (not shown), each LED 600 may be pulsed very briefly by controller 650 (and imperceptibly) to a very high level, and again, the difference is indicative of the individual LED's contribution as recorded by the one or more photosensors through the optical coupling means. An external camera (or the human eye) can be used to further correlate these measurements to their effects on overall luminaire spatial uniformity. The calibration algorithm used by controller 650 can be modeled after those used in calibrating tiled displays, for example, as disclosed in U.S. Pat. No. 6,219,099, having a common assignee with the instant application and incorporated by reference herein.

Within the controller 650 in FIG. 6, the dotted box entitled "NVM (Settings & Calibration Data)" represents a non-volatile memory (NVM) that may carry, at least in part, calibration data necessary to adjust the individual LEDs 600, over temperature, to maintain uniformity across the LED array.

In addition, once placed in operational mode, the individual bypass switches 640 may be used to trim the power to each LED 600 to ensure uniformity across the array over time. Also, the current sources 660 may be time-sequenced in order to provide better discrimination of the individual LED's contribution. For example, at the beginning of each video frame, the red channel's current source 660 can be turned-on, and each individual LED 600 can be pulsed in that channel, then the channel would be turned off while each of the other remaining channels (e.g., $Green_1$, Blue, and $Green_2$) are being tested. Since the LED response time is relatively fast (e.g. tens of nanoseconds), large numbers of LEDs could be tested each frame (if desired) without significantly impacting the maximum possible power available to the array (i.e. the remaining portion of the frame), and without being perceptible to an observer. Further, the current source 660 also may be configured to pulse LEDs 600 during normal operation to provide an average brightness level as perceived by the human eye. Such a technique, for example, may be more applicable to a row/column matrix drive approach.

As mentioned above, a suitable driver for individually pulsing the LEDs 600, such as, for example, Texas Instruments LED Driver IC (P/N TLC5940) may be utilized.

In accordance with exemplary embodiments, therefore, the feedback to compensate for LED-to-LED variations need only be fast-enough over the timeframe by which the effect becomes noticeable. By way of example, compensation for solarization effects need not occur every video frame.

One skilled in the art will also recognize that one or more elements shown in FIG. 6 can be integrated with the LED die, such as the shunt. Additionally, other functions can be integrated, such as a temperature sensor, current source, calibrated photosensor, internal calibration data, etc. In effect, the device becomes a "smartLED." Note that the functions can also be implemented in the LED-submount as described in U.S. Pat. No. 6,876,008.

The above exemplary embodiments in accordance with the invention provide a technique that may avoid the cost associated with LED-binning, while maintaining the ability to create uniform sources of illumination.

It should be understood that sizes, configurations, numbers, and positioning of various structural parts and materials used to make the above-mentioned parts are illustrative and exemplary only. One of ordinary skill in the art will recognize that those sizes, configurations, numbers, positioning, materials, and/or other parameters can be changed to produce different effects, desired characteristics, and/or to achieve different applications than those exemplified herein. In particular, the drawings illustrate schematic light source arrangements; the number of light sources, size of the light sources, overall size of the array, light sources, and other structural dimensions and configurations may vary depending on the desired application and operation of the device.

Though much of the above description discusses LCD backlighting as an embodiment, the need for uniform light source arrays in other applications are known as well, such as, for example, luminaires for general lighting (e.g. museums, supermarkets, etc.), medical applications (e.g. instrumentation, light therapy, endoscopy, surgical lighting, etc.) communications (fiber optics and free-space), signage (roadways, stadiums, indoor & outdoor advertising), and information displays (e.g. OLEDs). Those having skill in the art would understand how the embodiments described herein may be used in conjunction with such applications other than LCD backlighting applications.

The section headings used herein are for organizational purposes only, and are not to be construed as limiting the subject matter described. All documents cited in this application, including, but not limited to patents, patent applications, articles, books, and treatises, are expressly incorporated by reference in their entirety for any purpose. In the event that one or more of the incorporated literature and similar materials differs from or contradicts this application, including but not limited to defined terms, term usage, described techniques, or the like, this application controls.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations. Other embodiments of the invention will be apparent to those skilled in the art from consideration of the specification and practice of the invention disclosed herein.

What is claimed is:

1. A method for controlling light output of an array comprising a plurality of series-connected of light sources by a controller while maintaining a desired operating emittance of the array, each light of the array having a shunt switch, the method comprising:

energizing the array of series-connected plurality of light sources by applying a current necessary to generate for the desired operating emittance;

during a first time period, closing the shunt switch of a light source of the plurality of light sources, wherein the light source is extinguished;

sampling the remaining light of the array by an optical sensor during the first time period and during a second time period when the shunt switch is de-energized;

determining a difference in emittance between the first and second time periods;

comparing the difference in emittance to a luminance value stored in a memory associated with the shunted light source; and subsequently controlling the operation of the shunt switch based on the comparison, wherein the subsequent controlling produces the desired operating emittance of the array.

2. The method of claim 1, wherein the first time period is less than a time period of a flicker frequency.

3. The method of claim 1, wherein a loss of light from the extinguishment of the light source is imperceptible by humans.

4. The method of claim 1, wherein the plurality of series-connected of light sources are selected from a group consisting of: light emitting diodes, organic light emitting diodes, fluorescent lights, incandescent lights, and an liquid crystal display pixel.

5. The method of claim 1, further comprising determining a temperature of the light source by a temperature sensor.

6. The method of claim 5, wherein the stored luminance value is adjusted for the temperature of the light source by the controller.

7. The method of claim 1, wherein each light source of the plurality is extinguished in sequence as the method is repeated in an iterative fashion.

8. A method for controlling light output of an array comprising a plurality of series-connected of light sources by a controller while maintaining a desired operating emittance of the array, the method comprising:

during a first time period, pulsing current to a light source, wherein the light source is pulsed at a higher emittance;

sampling the light of the array by an optical sensor during the first time period and during a second time period when the current is not increased;

determining a difference in luminance between the first and second time periods;

comparing the difference in luminance to an emittance value stored in a memory associated with the shunted light source; and subsequently controlling the current based on the comparison, wherein the subsequent controlling produces the desired operating emittance of the array.

9. The method of claim 1, wherein each light source of the plurality is pulsed in sequence as the method is repeated in an iterative fashion.

10. The method of claim 1, further comprising energizing the array of series-connected plurality of light sources before the pulsing step by applying a current necessary to generate for the desired operating emittance.

11. The method of claim 9, wherein a pulse is a ramp up in current.

12. The method of claim 1, wherein each light source of the plurality is pulsed in sequence and in a different color as the method is repeated in an iterative fashion.

13. A method for controlling light output of an array comprising a plurality of series-connected of light sources by a controller while maintaining a desired operating emittance of the array, the method comprising:

during a first time period, ramping current to a light source sampling the light of the array by an optical sensor during the first time period and during a second time period when the current is not increased;

determining a difference in emittance between the first and second time periods;

comparing the difference in emittance to a luminance value stored in a memory associated with the shunted light source; and subsequently controlling the current based on the comparison, wherein the subsequent controlling produces the desired operating emittance of the array.

14. The method of claim 13, wherein the light source is ramped to one of a higher or lower luminance.

* * * * *